US009364029B2

(12) United States Patent
Patel

(10) Patent No.: US 9,364,029 B2
(45) Date of Patent: Jun. 14, 2016

(54) SOCK WITH HEEL PADDING AND METHOD OF MAKING SAME

(71) Applicant: Hiten Patel, Yorba Linda, CA (US)

(72) Inventor: Hiten Patel, Yorba Linda, CA (US)

( * ) Notice: Subject to any disclaimer, the term of this patent is extended or adjusted under 35 U.S.C. 154(b) by 598 days.

(21) Appl. No.: 13/868,757

(22) Filed: Apr. 23, 2013

(65) Prior Publication Data

US 2014/0059742 A1 Mar. 6, 2014

Related U.S. Application Data

(63) Continuation of application No. PCT/US2011/057901, filed on Oct. 26, 2011, which is a continuation-in-part of application No. 13/034,526, filed on Feb. 24, 2011, now abandoned.

(60) Provisional application No. 61/407,446, filed on Oct. 28, 2010.

(51) Int. Cl.

| | |
|---|---|
| ***A41B 11/00*** | (2006.01) |
| ***A41B 11/02*** | (2006.01) |
| *A41D 13/06* | (2006.01) |

(52) U.S. Cl.

CPC ..... *A41B 11/006* (2013.01); *A41B 11/02* (2013.01); *A41D 13/06* (2013.01)

(58) Field of Classification Search

CPC .... A41B 11/005; A41B 11/02; A41B 11/006; A41B 11/10; A43B 23/08; A43B 23/088

See application file for complete search history.

(56) References Cited

U.S. PATENT DOCUMENTS

| | | | | |
|---|---|---|---|---|
| 1,408,721 A | | 3/1922 | Carrel | |
| 1,712,420 A | | 5/1929 | Carlson | |
| 1,930,030 A | * | 10/1933 | Anderson | A41B 11/00 2/241 |
| 1,990,210 A | * | 2/1935 | Silver | A43B 23/28 36/58.5 |
| 2,090,683 A | * | 8/1937 | Koppe | A43B 23/28 36/58.5 |
| 2,293,714 A | * | 8/1942 | Craig | A41B 11/00 2/239 |
| 2,489,429 A | | 11/1949 | Nathan | |
| 2,617,992 A | * | 11/1952 | Bean | A41B 11/00 128/892 |
| 2,657,478 A | * | 11/1953 | Paul | A41B 11/00 36/10 |
| 2,774,152 A | | 12/1956 | Alber | |
| 3,003,154 A | | 10/1961 | Litman | |
| 3,039,907 A | | 6/1962 | Scholl | |

(Continued)

FOREIGN PATENT DOCUMENTS

| | | |
|---|---|---|
| DE | 202004005881 | 7/2004 |
| DE | 202007001072 | 5/2008 |

(Continued)

OTHER PUBLICATIONS

"Insoles for Men's Shoes: Who's Gellin'," Consumer Reports, http://health.yahoo.net/articles/mens-health/insoles-mens-shoes-whos-gellin, last visited Mar. 15, 2011.

(Continued)

*Primary Examiner* — Shaun R Hurley
*Assistant Examiner* — Andrew W Sutton
(74) *Attorney, Agent, or Firm* — Knobbe, Martens, Olson & Bear, LLP

(57) ABSTRACT

Embodiments of socks having at least one heel padding are disclosed herein. The at least one heel padding can be attached to the heel pocket area of a sock, preferably in the top half of the heel pocket area. Such socks can be particularly advantageous in improving the comfort, as well as the fit of shoes on a person's feet.

19 Claims, 4 Drawing Sheets

(56) References Cited

U.S. PATENT DOCUMENTS

| | | | | |
|---|---|---|---|---|
| 3,266,058 | A * | 8/1966 | Guttman | A61F 13/069 2/16 |
| 3,269,038 | A * | 8/1966 | Abel | A43B 23/28 2/241 |
| 4,008,350 | A | 2/1977 | Crawford et al. | |
| 4,150,442 | A * | 4/1979 | Boone | A41D 13/06 128/892 |
| 4,277,959 | A * | 7/1981 | Thorneburg | A41B 11/02 2/239 |
| 5,092,347 | A | 3/1992 | Shaffer et al. | |
| 5,133,088 | A | 7/1992 | Dunlap | |
| 5,307,522 | A | 5/1994 | Throneburg et al. | |
| 5,596,770 | A | 1/1997 | Kunesh | |
| 5,603,232 | A | 2/1997 | Throneburg | |
| 5,617,745 | A | 4/1997 | Della Corte et al. | |
| 5,625,904 | A * | 5/1997 | Kline | A41B 11/006 2/239 |
| 5,645,525 | A * | 7/1997 | Krivosha | A61F 5/34 602/62 |
| 5,675,992 | A | 10/1997 | Wrightenberry | |
| 5,768,713 | A | 6/1998 | Crick | |
| 5,771,495 | A | 6/1998 | Turner et al. | |
| 5,784,721 | A | 7/1998 | Huff | |
| 5,842,292 | A | 12/1998 | Siesel | |
| 5,898,948 | A | 5/1999 | Kelly et al. | |
| 6,021,527 | A | 2/2000 | Lessard | |
| 6,173,452 | B1 * | 1/2001 | Kelly | A41B 11/00 2/239 |
| 6,275,997 | B1 | 8/2001 | Richardson | |
| 6,292,951 | B1 | 9/2001 | Kalde | |
| 6,612,136 | B2 | 9/2003 | Roe | |
| D484,302 | S | 12/2003 | Dickson | |
| 6,668,387 | B2 | 12/2003 | Kalde | |
| 6,673,054 | B1 | 1/2004 | Gould | |
| 6,852,269 | B2 | 2/2005 | Eberle et al. | |
| 7,681,254 | B2 | 3/2010 | Lambertz | |
| 7,971,280 | B2 * | 7/2011 | Kaneda | A41B 11/02 2/239 |
| 8,424,117 | B2 | 4/2013 | Hasan et al. | |
| 2003/0167548 | A1 * | 9/2003 | LaShoto | A41D 13/015 2/22 |
| 2005/0107728 | A1 * | 5/2005 | Vetters | A41B 11/008 602/23 |
| 2006/0026740 | A1 * | 2/2006 | Vargas | A41B 11/02 2/239 |
| 2006/0179549 | A1 | 8/2006 | Huggins et al. | |
| 2006/0253962 | A1 * | 11/2006 | Hua | A41B 11/02 2/239 |
| 2007/0192938 | A1 | 8/2007 | Yoon | |
| 2008/0209616 | A1 | 9/2008 | Manning et al. | |
| 2009/0113602 | A1 | 5/2009 | Lambertz | |
| 2009/0113603 | A1 | 5/2009 | Liu | |
| 2009/0223254 | A1 * | 9/2009 | Ishida | D04B 1/108 66/185 |
| 2009/0293179 | A1 | 12/2009 | Hasan | |
| 2010/0031706 | A1 * | 2/2010 | Chaveau | A41B 11/005 66/178 R |
| 2010/0043124 | A1 | 2/2010 | Arakelian et al. | |
| 2010/0050320 | A1 * | 3/2010 | Canci | A41B 11/02 2/239 |
| 2010/0186255 | A1 * | 7/2010 | Avar | A43B 3/0036 36/10 |
| 2011/0000006 | A1 | 1/2011 | Fehring | |
| 2011/0296588 | A1 * | 12/2011 | Cummings | A41B 11/006 2/239 |
| 2012/0102626 | A1 * | 5/2012 | Patel | A41B 11/02 2/239 |
| 2012/0198731 | A1 * | 8/2012 | Barge | A43B 13/41 36/70 R |
| 2014/0053320 | A1 * | 2/2014 | Hasan | A41B 11/02 2/239 |
| 2014/0059742 | A1 * | 3/2014 | Patel | A41B 11/02 2/239 |
| 2014/0090273 | A1 * | 4/2014 | Piontkowski | A43B 7/1425 36/44 |

FOREIGN PATENT DOCUMENTS

| | | |
|---|---|---|
| EP | 1897456 | 3/2008 |
| FR | 2328413 | 5/1977 |
| FR | 2897756 | 8/2007 |
| GB | 1552320 | 9/1979 |
| GB | 2337446 | 11/1999 |
| WO | WO 00/74619 | 12/2000 |

OTHER PUBLICATIONS

"Boot Bumper," Silipos, http://www.silipos.com/003_prod/product.aspx?cat_name=Orthopedics&subcat_name=Sleeves%20&%20Wraps&product_name=Boot%20Bumper&product_id=177x&cat_id=7&subcat_id=4, last visited Mar. 15, 2011.

"CVS Women's Heel Liners for All Shoes Types & Sizes", http://www.cvs.com/shop/product-detail/CVS-Womens-Heel-Liners-for-All-Shoe-Types-&-Sizes?skuId=698427, last visited Feb. 25, 2014.

"Dr. Scholl's® for Her Heel Liners", http://www.drscholls.com/Products/ForHerHeelLiners, last visited Feb. 25, 2014.

"Men's Fit & Value Insoles," SofComfort, http://www.sofcomfort.com/mens_fit_value.aspx, last visited Feb. 25, 2014.

International Search Report dated Jan. 13, 2012 for PCT/US2011/057901.

Achilles agony, by Dr. Jordan D. Metzl, MD, www.TriathleteMag.com, Apr. 2006.

Malanga, et al. Common Injuries of the Foot and Ankle in the Child and Adolescent Athlete. Phys. Med. Rehabil. Clin. N. Am 19 (2008) 347-371.

* cited by examiner

SOCK WITH HEEL PADDING AND METHOD OF MAKING SAME

CROSS-REFERENCE TO RELATED APPLICATIONS

Any and all priority claims identified in the Application Data Sheet, or any correction thereto, are hereby incorporated by reference under 37 CFR 1.57.

TECHNICAL FIELD

The disclosure relates in general to the field of hosiery and more particularly to socks that have an insert to enhance the fit of shoes on a person's feet.

BACKGROUND

Finding a shoe that fits properly or comfortably can be a challenge. People are often forced to wear shoes that fit poorly because their feet do not fit within a conventional shoe size. Even when selecting among the best fitting size available for a given shoe style, the shoe may not necessarily fit well or comfortably. For example, a person's feet size may fall in-between shoe sizes. When shoes do not fit properly, the shoes have a tendency to slip off a person's feet. For example, the back portion of a shoe sometimes slips off a person's heel during walking, running, or other types of activity. In addition, the person's feet can move around excessively inside the shoe, resulting in abrasion and sores. There are no known devices that address these issues effectively to improve shoe comfort and fit.

SUMMARY OF THE DISCLOSURE

Embodiments of the improved sock address a dilemma many consumers find themselves in whenever their feet size is in-between shoe sizes. Shoe fit and comfort is left desired when a consumer is forced to choose between a shoe that is too tight and a shoe that is oversized. The wearer of an embodiment of the improved sock can achieve this desirable shoe fit and comfort even if the shoe size does not match the wearer's foot size.

In accordance with at least one of the embodiments disclosed herein, the improved sock is for use with an oversized shoe. Similar to a conventional shoe, the oversized shoe has a counter and a topline above the counter. The improved sock compensates for gaps in an oversized shoe, such as the one between the heel of a wearer and the counter, by assisting to push the foot forward in the shoe; in some embodiments, the improved sock can push the foot completely forward in the shoe. The improved sock comprises a toe portion, a foot portion, a heel pocket area, and an upper cuff portion with an opening to receive a foot of a wearer, wherein the foot portion extends from the toe portion to the heel pocket area, and the upper cuff portion is positioned on an end of the sock opposite the toe portion. At least one heel padding is disposed within the heel pocket area, and the combined thickness of the sock and the at least one heel padding can be roughly equal to the gap between the wearer's heel and the shoe counter; and in some embodiments, the thickness can be at least equal to the gap between the wearer's heel and the shoe counter. The at least one heel padding is configured on the sock to be positioned below the shoe topline and push the wearer's foot forward inside the shoe. The heel pocket area is defined as an area of the sock that extends from the base of the wearer's heel bone to approximately the calcaneal insertion of the Achilles tendon when the sock is worn by the wearer.

In some embodiments, the improved sock further comprises a pouch disposed in the heel pocket area for receiving the at least one heel padding. In some embodiments, the at least one heel padding is removably coupled to the sock. In some embodiments, the at least one heel padding wraps partially around the heel pocket area such that the at least one heel padding rests below the wearer's Achilles tendon when the sock is worn by the wearer.

In another embodiment, the improved sock is for use with an oversized shoe. Similar to a conventional shoe, the oversized shoe has a counter and a topline above the counter, wherein the topline defines an opening for receiving a wearer's foot. The improved sock comprises a toe portion, a foot portion, a heel pocket area, and an upper cuff portion with an opening to receive a foot of a wearer, wherein the foot portion extends from the toe portion to the heel pocket area, and the upper cuff portion is positioned on an end of the sock opposite the toe portion. At least one heel padding is disposed within the heel pocket area. The at least one heel padding is configured on the sock to be positioned below the shoe topline and push the wearer's foot forward inside the shoe. The heel pocket area is defined as an area of the sock that extends from the base of the wearer's heel bone to approximately the calcaneal insertion of the Achilles tendon when the sock is worn by the wearer.

In some embodiments, the at least one heel padding is disposed in the top half of the heel pocket area such that the at least one heel padding is positioned to cover a majority of a posterior aspect of the wearer's heel bone when the sock is worn by the wearer. In some embodiments, the at least one heel padding has a short-axis and long-axis, and is symmetrical along at least one of the axes. In some embodiments, the at least one heel padding can conform to a curvature of an interior surface of the counter of the shoe. In some embodiments, the at least one heel padding can extend beyond the heel pocket area so that a superior edge of the at least one heel padding is disposed between the calcaneal insertion of the Achilles tendon and the shoe topline when the sock is worn by the wearer in the shoe. In some embodiments, the at least one heel padding is made of a polyurethane foam. In some embodiments, the at least one heel padding is integrated with the sock. In other embodiments, the at least one heel padding is removably coupled to the sock. In some embodiments, the at least one heel padding is attached with stitch-free or seamless methods.

In some embodiments, the improved sock further comprises a pouch disposed in the heel pocket area for receiving the at least one heel padding and securing the at least one heel padding to the sock. The pouch can be adjustable to receive one or more heel paddings. The pouch can be attached to the sock with stitch-free or seamless methods. In some embodiments, the at least one heel padding can be adjusted within the heel pocket area and positioned to achieve a target orientation for maximizing individual fit and comfort of the wearer.

In some embodiments, the improved sock further comprises marked reinforced sections in the heel pocket area. The marked reinforced sections provide landmarks for the wearer to achieve target orientation of the at least one heel padding on the sock.

In accordance with other embodiments disclosed herein, a sock for use with a shoe having a counter and a topline above the counter is disclosed. The sock can have a toe portion, a foot portion, a heel pocket area, and an upper cuff portion with an opening to receive a foot of a wearer. The foot portion can extend from the toe portion to the heel pocket area and the upper cuff portion can be positioned on an end of the sock opposite the toe portion. In some embodiments, the heel pocket area is defined as an area of the sock that extends from a base of the wearer's heel bone to approximately a calcaneal insertion of the Achilles tendon when the sock is worn by the wearer. A pouch can be disposed in the heel pocket area and can be configured to receive at least one heel padding. The at least one heel padding can be configured to be positioned below the shoe topline and configured to push the wearer's foot forward inside the shoe. The sock can be used with the at least one heel padding in some embodiments, and without the at least one heel padding in other embodiments.

Methods for making the improved sock are disclosed herein. In some embodiments, the method is for making a sock for use with an oversized shoe. The shoe has a counter and a topline above the counter. The topline defines an opening for receiving a wearer's foot. The method, in some embodiments, comprises defining a heel pocket area on the sock for receiving the heel of a wearer such that the heel pocket area extends roughly from the base of the wearer's heel bone to approximately the calcaneal insertion of the Achilles tendon when the sock is worn by the wearer. The method further comprises, providing at least one heel padding that is symmetrical from left and right, and front and back, the at least one heel padding comprising a symmetrical line separating the left and right. The method further comprises defining a target orientation within the heel pocket area for positioning the at least one heel padding to maximize shoe fit and comfort of the wearer. The method further comprises positioning the at least one heel padding within the target orientation and aligning the symmetrical line of the at least one heel padding coincident with the sagittal plane of the foot upon wearing. The method further comprises coupling the at least one heel padding to the sock.

In some embodiments, the at least one heel padding is integrally made with the sock. The method can comprise sewing the at least one heel padding to the sock. In other embodiments, the method comprises adhering the at least one heel padding to the sock. The at least one heel padding can be attached to the sock using a stitch-free or seamless method.

In some embodiments, the method further comprises creating a pouch on the sock within the heel pocket area for receiving the at least one heel padding. The pouch can be positioned to align the at least one heel padding into a target position to cover a majority of a posterior aspect of the wearer's heel bone when the sock is worn by the wearer. The pouch can be attached to the sock using a stitch-free or seamless method. In some embodiments, the method includes placing the at least one heel padding in the pouch and positioning the at least one heel padding on a top half of the heel pocket area such that the symmetrical line of the at least one heel padding is coincident with the sagittal plane of the foot upon wearing.

In some embodiments, the method comprises selecting a material for the at least one heel padding from a selection consisting of polyurethane, cotton, cotton-polyester blend, nylon, vinyl, rubber, leather, satin, or silicone.

Although certain embodiments, features, and examples have been described herein, it will be understood by those skilled in the art that many aspects of the methods and devices illustrated and described in the present disclosure may be differently combined and/or modified to form still further embodiments. For example, any one component of the sock assembly illustrated and described above can be used alone or with other components without departing from the spirit of the present invention. Additionally, it will be recognized that the methods described herein may be practiced in different sequences, and/or with additional devices as desired.

BRIEF DESCRIPTION OF THE DRAWINGS

Specific embodiments and modifications thereof will become apparent to those skilled in the art from the detailed description herein having reference to the figures that follow, of which.

DETAILED DESCRIPTION OF SPECIFIC EMBODIMENTS

Socks with heel padding, described herein, can improve the fit of shoes on a person's feet. The wearer of an embodiment of these improved socks can have an improved shoe fit without having to resort to uncomfortable options.

Many consumers find themselves in-between shoe sizes, such as when one particular size of shoe is too tight yet the next available shoe size is slightly too large. Retrofitting a slightly oversized shoe by stuffing the toe portion with various materials or by attempting to wear double or thicker socks are not ideal solutions and may in fact lower the overall level of comfort for the consumer. From a retail perspective, consumers would worry less about purchasing a shoe that does not fit well if they had socks with heel padding. For example, caregivers of children and adolescents may take a keen interest in this sock concept as this population experiences a high turnover of shoes from growth spurts. Also, individuals with a prior inventory of slightly oversized shoes may be able to take advantage of the improved fit afforded by using embodiments of socks with heel padding.

A person can wear an embodiment of the improved sock in a manner similar to that used when wearing any other kind of sock. A person can pull on an individual sock onto the desired foot and make any adjustments necessary to maximize comfort prior to inserting the outfitted foot into a respective shoe. When the person wears the device in a shoe, his/her foot can be positioned slightly forward in the shoe. Additionally, the medial and lateral sides of the heel can be supported against the sides of the shoe. The positioning of the foot anteriorly in the shoe can be attributed to the cushioning provided by the heel padding and the minimizing of any potential gap between the wearer's heel and the shoe counter.

A sock having desirable features and advantages will now be described with reference to the figures. Although the following description is provided in the context of an exemplifying sock with heel padding, the features of the present sock can provide advantages in other applications as well, for example stockings, gloves, helmets, etc.

Figure 1:
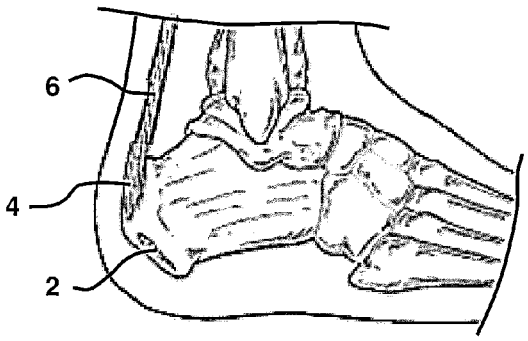
FIG. 1 is a close-up, cross-sectional view of a rear portion of a foot of a person showing the internal anatomy.

The illustration in FIG. 1 shows a close-up side view of the internal anatomy of a rear portion of a foot of a person. The heel bone 2, or calcaneus, is the largest bone of the foot and forms the foundation of the rear portion of the foot. The Achilles tendon 6 is the largest and strongest tendon of the foot and originates from the calf muscles and attaches to the heel bone 2 at the calcaneal insertion 4 located on the posterior surface of the heel bone 2. Reviewing the anatomical structures depicted in FIG. 1 can be useful in understanding the embodiments of the improved sock with heel padding discussed in detail below.

Figure 1A:
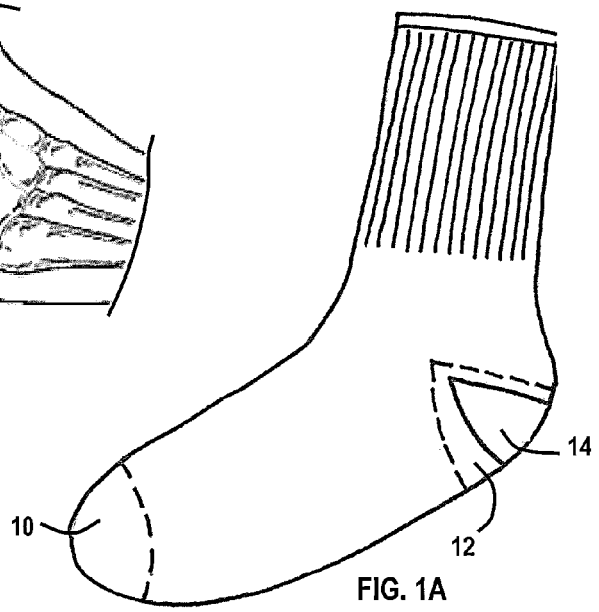
FIG. 1A is a side view of a sock according to an embodiment of the present invention.
Figure 1B:
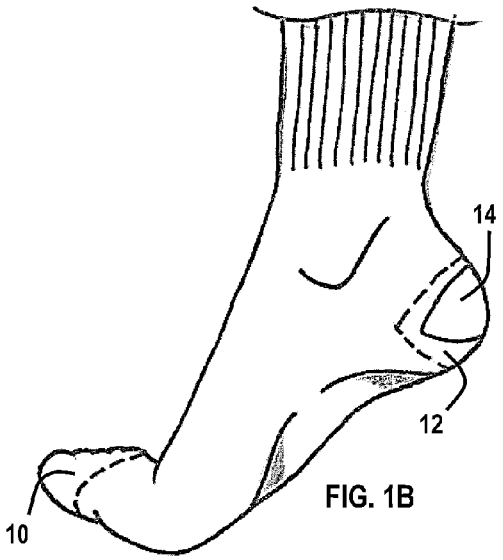
FIG. 1B is a perspective view of the sock of FIG. 1A, as worn on the right foot of a person.
Figure 1C:
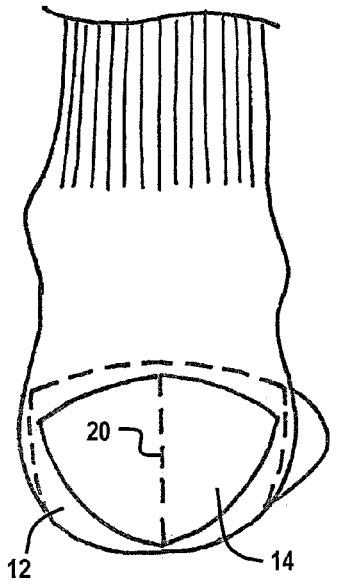
FIG. 1C is a rear view of the sock of FIG. 1A, as worn on a foot of a person.

An embodiment of the improved sock is shown in FIGS. 1A-1C, with padding, support, or cushioning at the heel portion of the sock. As illustrated in FIG. 1A, the sock can have a foot portion extending from the toe area 10 to the heel pocket area 12 and a leg portion extending from the heel pocket area 12 to an upper cuff portion. A heel padding 14 can be located in the heel pocket area 12, preferably in the top half of the heel pocket area 12. Excessive exposure of the heel padding 14 towards the bottom half of the heel pocket area 12 is preferably avoided to prevent the likelihood of the heel padding 14 encroaching onto the plantar (bottom) surface of the foot upon wearing.

The final manufactured product preferably will have the heel padding 14 affixed at a desired location as described above. However, it can be possible that the wearer may wear the sock with the heel padding 14 in an improper position on the foot. To help avoid this situation, the heel padding 14 can be manually adjusted by the wearer into a target position to cover the majority of the posterior aspect and portions of the medial and lateral aspects of the heel bone 2 of the foot, as illustrated in FIGS. 1B and 1C. This target position can allow for the heel padding 14 to best cradle the curvature provided by the interior surface of the rear shoe counter area of a conventional shoe. Also, reinforced sections of the heel pocket area 12 and toe area 10 marked on many commercially available socks can assist the wearer in achieving this target orientation since visualization of these landmarks can minimize potential misalignments, such as the heel padding 14 sitting too high, too low, or skewed medially or laterally on the foot upon wearing. It should be noted that the presence of marked reinforced sections for the heel pocket area 12 and toe area 10 can be optional elements for the final manufactured version of this sock assembly. Borders for these optional areas are shown with dashed lines in the figures.

In some embodiments of the sock assembly, the heel padding 14 can be permanently attached to the sock by any method now known or discovered in the future, such as sewing, hook and loop fasteners, snaps, adhesives, Velcro, bonding fabric, fusible web or other fusible materials, thermoplastic films, tapes etc. In embodiments where the heel padding 14 is sewn to the sock, a plurality of different types of thread and a plurality of different types of stitching can be used. Some embodiments can use stitch-free or seamless technology, where the heel padding 14 can be adhered to the sock using fabric welding techniques that can employ heat and pressure, such as by ultrasonic heating, high frequency radiation, or using thermoplastic film. Stitch-free or seamless technology can advantageously provide a smooth feel to the sock assembly when worn on the foot, which can be more comfortable because of reduced chafing or rubbing against the foot. Other advantages of the stitch-free or seamless technology can include reduced weight, improved aesthetics and shorter manufacturing time. The heel padding 14 can be coupled to the exterior of the sock or coupled to the interior of the sock. In some embodiments, the heel padding 14 can be an integrated component of the sock, such as for example where the heel padding 14 is embedded in the sock.

Figure 1D:
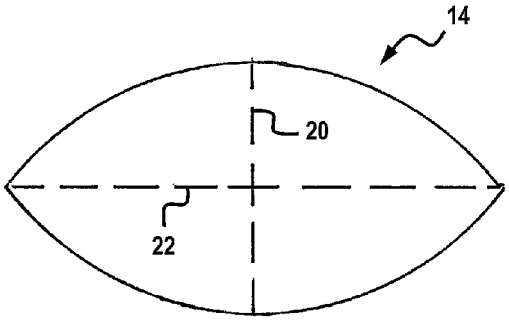
FIG. 1D is a plan view of a heel padding member according to an embodiment of the present invention.

The heel padding 14 can have a generally elliptical or ovular shape with opposing ends tapering to generally a point, as shown in FIG. 1D, with a short-axis 20 that is approximately half the length of the long-axis 22. In some embodiments, the short-axis 20 can be at least approximately 1 inch and/or less than or equal to approximately 3 inches in length. The long-axis 22 can be at least approximately 2 inches and/or less than or equal to approximately 5 inches in length. In other embodiments, the length of the short-axis 20 and/or the length of the long-axis 22 can be any other dimension.

It should be noted that the heel padding 14, as shown in FIG. 1D, can possess lines of symmetry along the short-axis 20 and long-axis 22 that allow the heel padding 14 to retain the same landscape footprint regardless of rotation along either axes, which can advantageously help with simplicity and speed during the manufacturing process. Also, the line of symmetry along the short-axis 20 can be coincident to the sagittal plane of the foot upon wearing, as shown in FIG. 1C, allowing the final manufactured sock assembly the flexibility to be worn on either foot, similar to a conventional sock.

In other embodiments, alternative shapes of the heel padding 14, with or without lines of symmetry, are also contemplated. The overall dimensions of the heel padding 14 can vary taking into account the size of the final manufactured product (e.g., a smaller padding member reserved for socks worn by children and a larger padding member reserved for socks worn by adults). The thickness of the heel padding 14 can be at least approximately 0.125 inch (⅛ inch) and/or less than or equal to approximately 0.375 inch (⅜ inch), although other thicknesses are contemplated as well.

The material of the heel padding 14 can be made of a flexible and durable material such as polyurethane foam. However, use of other materials such as cotton, cotton-polyester blends, nylon, vinyl, rubber, leather, satin, suede, gel, silicone, fluid-filled material, Lycra, Spandex, or any other natural or synthetic textile material is also contemplated.

Although the sock assembly illustrated in FIGS. 1A-1C is an athletic-type sock, the heel padding 14 can be incorporated into any sock type (e.g., no-show, ankle, quarter, crew, over-the-calf, athletic, casual, dress, men's, women's, etc.) or any sock size (e.g., infant, child, adolescent, adult, etc.).

At least some of the benefits of the improved sock disclosed herein can be understood by examining the fit of a conventional sock compared to the fit of an embodiment of a sock with heel padding 14 on a foot of an individual wearing an oversized shoe. When wearing a conventional sock, the wearer must first position the conventional sock onto the desired foot and ensure that the toe area and heel pocket area of the sock adequately cover the respective areas of the foot. It may be necessary for the wearer to manually adjust the conventional sock onto the foot to maximize comfort. For example, excessive bunching or gathering of sock material in any one particular area can be minimized by pulling the sock up to obtain the best possible fit for the wearer's foot. This process of wearing the conventional sock into the ideal wearing position can be facilitated by using the reinforced sections of the toe area and heel pocket area, if present, as landmarks.

Figure 1E:
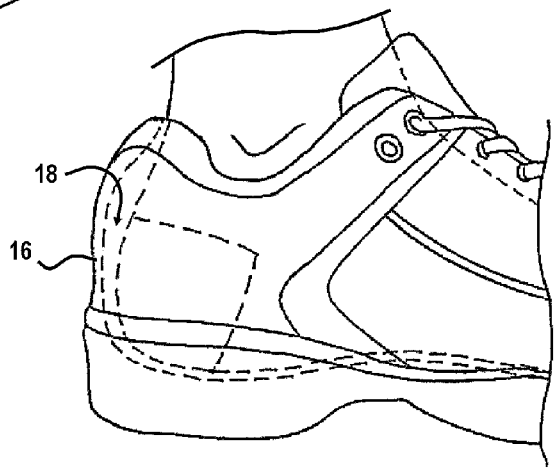
FIG. 1E is a close-up side view of a foot of a person wearing a conventional sock in an oversized shoe exposing a gap between the rear of the wearer's foot and the shoe counter.

It should be noted that the presence of these landmarks is optional since not all commercially available socks include this feature. After a suitable sock position on the foot is achieved, the wearer can then insert the outfitted foot into a respective shoe. It should be noted that the wearer can adjust or flex the various segments of his/her foot (e.g., forefoot, midfoot, and hindfoot) and ankle inside the shoe to ensure a comfortable resting position. When the wearer pushes his/her outfitted foot forward such that the toe area of the sock is in the proper position in the shoe, a gap 18 can be exposed between the rear of the conventional sock and the shoe counter 16, as shown in FIG. 1E. The use of an oversized shoe can result in a significant gap 18 in this area such that the overall fit is poor and the comfort level for the wearer is low. The poorly fitting shoe can lead to the foot slipping out of the shoe during activity or lead to the development of painful sores or abrasions.

Figure 1F:
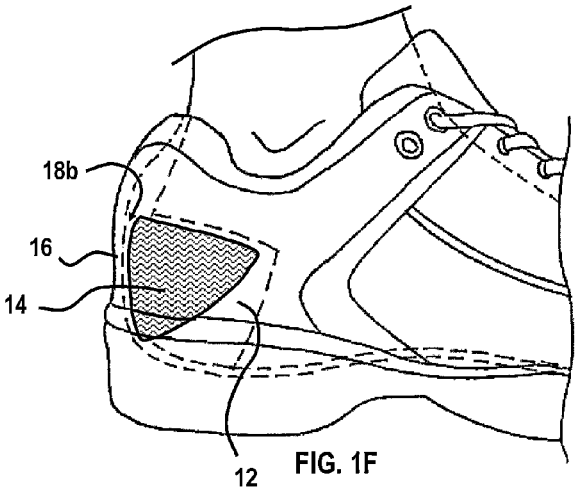
FIG. 1F is a close-up side view of a foot of a person wearing a sock according to an embodiment of the present invention in an oversized shoe.

When an individual wears an embodiment of the sock with heel padding 14, the wearer can position the sock with heel padding 14 into the target position allowing the heel padding 14 to cover a majority of the posterior aspect and portions of the medial and lateral aspects of the heel of the foot. As stated above, the wearer can make use of landmarks provided by the reinforced sections of the toe area 10 and heel pocket area 12 of the sock, if present. The presence of these landmarks is optional. After the desired positioning of the sock with heel padding 14 is achieved around the wearer's foot, the wearer can insert his/her outfitted foot into the respective shoe. As before, the wearer can adjust or flex the various segments of his/her foot (e.g., forefoot, midfoot, and hindfoot) and ankle inside the shoe to ensure a comfortable resting position. After pushing his/her outfitted foot forward such that the toe area 10 of the sock is in the proper position in the shoe, a reduced gap 18*b* between the rear of the wearer's foot and the shoe counter 16 can be exposed, as illustrated in FIG. 1F. The reduced gap 18*b* can be smaller than the gap 18 observed when wearing the conventional sock. In these embodiments, the combined thickness of the sock and heel padding 14 can be less than the width between the wearer's foot and the shoe counter 16. In other embodiments, the reduced gap 18*b* can be absent, wherein the sock and heel padding 14 fills substantially the entire width between the rear of the wearer's foot and the shoe counter 16. The combined thickness of the sock and heel padding 14 can be approximately equal to or greater than the width between the rear of the wearer's foot and the shoe counter 16. Some benefits afforded to the wearer of an embodiment of the sock with heel padding 14 include an improved fit, an increased level of comfort, and a reduced tendency of the foot to slip out of its respective shoe. It should be noted that the embodiment of the sock with heel padding 14 and shoe depicted in FIG. 1F are of an athletic-type, however, the sock with heel padding and the benefits disclosed herein are contemplated for use with a plurality of different sock types in combination with a plurality of different shoe types.

Figure 2A:
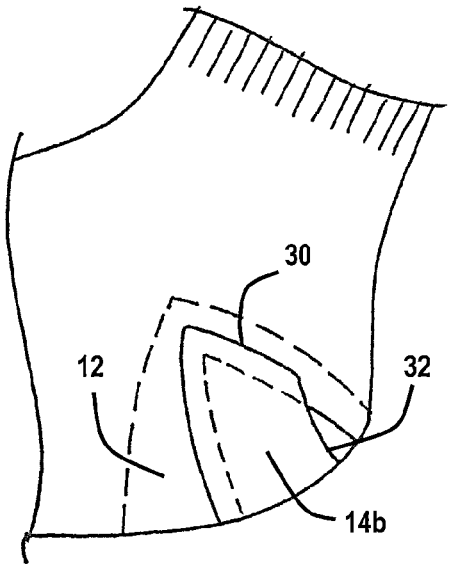
FIG. 2A is a close-up side view of the heel region of a sock according to an alternative embodiment of the present invention.
Figure 2B:
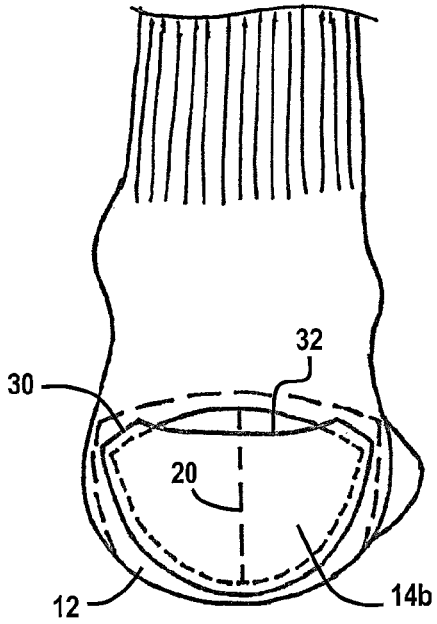
FIG. 2B is a rear view of the sock of FIG. 2A, as worn on a foot of a person.

An alternative embodiment of the sock assembly is shown in FIGS. 2A and 2B. In these embodiments, the heel padding 14*b* can be a removable member that can be inserted into an attached pouch 30 to achieve the desired effect of adding cushioning to the rear area of the sock, as illustrated in FIG. 2A. In other embodiments, other retention devices, such as a pocket or sleeve can be used. The location of the pouch 30 with respective heel padding 14*b* can be located in an area similar to that of the embodiment described above (i.e., primarily in the top half of the heel pocket area 12). Excessive exposure of the pouch 30 with respective heel padding 14*b* towards the bottom half of the heel pocket area 12 is preferably avoided to prevent the likelihood of the pouch 30 and heel padding 14*b* encroaching onto the plantar (bottom) surface of the foot upon wearing. Similar to the other embodiments described above, the wearer can manually adjust the pouch 30 with respective heel padding 14*b* into the proper target orientation prior to placing the foot into a shoe. As noted in the embodiments above, the presence of marked reinforced sections for the heel pocket area 12 and toe area 10 are optional elements for the final manufactured version. The outline borders for these optional areas are shown with dashed lines in FIGS. 2A and 2B.

In some embodiments, the pouch 30 can be permanently attached to the rear area of the sock by any method now known or discovered in the future, such as sewing, hook and loop fasteners, snaps, adhesives, Velcro, bonding fabric, fusible web or other fusible materials, thermoplastic films, tapes etc. In embodiments where the pouch 30 is sewn to the sock, a plurality of different types of thread and a plurality of different types of stitching can be used. Some embodiments can use stitch-free or seamless technology, where the pouch 30 can be adhered to the sock using fabric welding techniques that can employ heat and pressure, such as by ultrasonic heating, high frequency radiation, or using thermoplastic film. The pouch 30 can be coupled to the exterior of the sock or coupled to the interior of the sock. When worn, the sock with heel padding 14*b* in its respective pouch 30 can provide adequate coverage of the rear of the foot as shown in FIG. 2B, similar to the coverage offered by embodiments of the sock with heel padding 14 described above.

In some embodiments, the heel padding 14*b* can have a shape and dimensions similar to that disclosed for the first embodiment of the heel padding 14 discussed above. The pouch 30 can have an overall shape similar to its heel padding 14*b* counterpart. The pouch 30 can also have a point of entry to allow for insertion of the heel padding 14*b*. Preferably, the pouch 30 does not include a backing liner, although the inclusion of a liner made of any suitable natural or synthetic textile material can be allowable.

A point of entry 32 can be located on the superior margin of the pouch 30 to allow for insertion of the heel padding 14*b* from the top after wearing the sock (FIG. 2B). The heel padding 14*b* can alternatively be inserted into the pouch 30 prior to wearing the sock. Folding or manipulation of the heel padding 14*b* may be required to facilitate its insertion into the pouch 30. Other shapes for the pouch 30 and alternative points of entry are also contemplated such that the final pouch 30 allows for the insertion of the heel padding 14*b*.

Similarly, other shapes for the heel padding 14*b* are contemplated that can be easily inserted into the pouch 30 by the wearer. Although the axes of symmetry as described above can be advantageous from a manufacturing perspective, some embodiments of the pouch 30 and of the heel padding 14*b* need not possess axes of symmetry. The overall dimensions of the heel padding 14*b* with associated pouch 30 can vary taking into account the size of the final manufactured product (e.g., a smaller padding member and pouch combination reserved for socks worn by children and a larger padding member and pouch combination reserved for socks worn by adults). The thickness of the heel padding 14*b* can be at least approximately 0.125 inch (⅛ inch) and/or less than or equal to approximately 0.375 inch (⅜ inch), although other thicknesses are also contemplated. The thickness of the pouch 30 can be at least approximately 0.125 inch (⅛ inch) and/or less than or equal to approximately 0.25 inch (¼ inch), although other thicknesses are also contemplated.

In some embodiments, the final manufactured product can be offered to consumers in packaging containing multiple heel paddings 14*b* of varying thicknesses (e.g., ⅛ inch, ¼ inch, and ⅜ inch thickness presentations) to allow the wearer the added flexibility to further customize the level of cushioning required to obtain the best shoe fit. A wearer can elect to use a single, none, or any other combination of heel paddings 14*b* for insertion into the pouch 30. In some embodiments, the cushioning of the sock assembly for the left foot can be customized differently from the cushioning of the sock assembly for the right foot. For example, one sock assembly can be worn with no heel padding, while the other sock assembly can have one, two, or any other combination of heel padding. This opportunity to customize the fitting for each foot separately can be especially advantageous for an individual with mis-matched feet, as the size of one foot may not necessarily be the same size as the other foot. In some embodiments, the point of entry 32 on the pouch 30 can be closed, such as by the use of zippers, hooks, buttons, fasteners, snaps, or other closure devices.

The material of the heel padding 14*b* of at least this alternative embodiment can be made of a flexible and durable material such as polyurethane foam. However, the use of other materials such as cotton, cotton-polyester blends, nylon, vinyl, rubber, leather, satin, suede, gel, silicone, fluid-filled material, Lycra, Spandex, plastic or any other natural or synthetic textile material are also contemplated. The pouch 30 can be made of various natural or synthetic textile materials, such as plastic, rubber, Lycra, Spandex, stretch fabrics, mesh, or other suitable material that would be able to accommodate one or more removable heel paddings 14*b*.

The sock illustrated in FIGS. 2A and 2B is an athletic-type sock, but the pouch 30 and respective heel padding 14*b* can be incorporated into any sock type (e.g., no-show, ankle, quarter, crew, over-the-calf, athletic, casual, dress, men's, women's, etc) or any sock size (e.g., infant, child, adolescent, adult, etc).

Figure 3A:
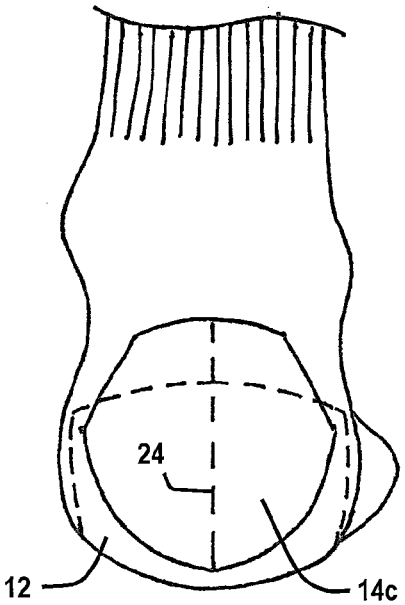
FIG. 3A is a rear view of a sock according to another alternative embodiment of the present invention, as worn on a foot of a person.

Another embodiment of the sock assembly is shown in FIG. 3A. In the illustrated embodiment, the heel padding 14*c* covers a larger area of the back of the foot, for example spanning from the margin of the posterior, inferior aspect of the heel bone 2 and extending beyond the heel pocket area 12 so that the superior edge of the heel padding 14*c* is disposed between the calcaneal insertion 4 of the Achilles tendon 6 and the shoe topline when the sock is worn by the wearer. This greater hindfoot coverage can allow the wearer the advantage of positioning the foot forward in the shoe for improving shoe fit while also providing an added cushioning element between the upper portion of the hindfoot and the upper portion of the shoe counter. Excessive exposure of the heel padding 14*c* towards the bottom half of the heel pocket area 12 is preferably avoided to prevent the likelihood of the heel padding 14*c* encroaching onto the plantar (bottom) surface of the foot upon wearing. Similar to the embodiments described above, the wearer can manually adjust the heel padding 14*c* into the proper target orientation prior to placing the foot into the shoe. As noted in the embodiments above, the presence of marked reinforced sections for the heel pocket area 12 and toe area 10 can be optional elements for the final manufactured version of this alternative embodiment. Borders for these optional areas are shown with dashed lines in FIG. 3A.

In some embodiments of the sock assembly, the heel padding 14*c* can be permanently attached to the sock by any method now known or discovered in the future, such as sewing, hook and loop fasteners, snaps, adhesives, Velcro, bonding fabric, fusible web or other fusible materials, thermoplastic films, tapes etc. In embodiments where the heel padding 14*c* is sewn to the sock, a plurality of different types of thread and a plurality of different types of stitching can be used. Some embodiments can use stitch-free or seamless technology, where the heel padding 14*c* can be adhered to the sock using fabric welding techniques that can employ heat and pressure, such as by ultrasonic heating, high frequency radiation, or using thermoplastic film. The heel padding 14*c* can be coupled to the exterior of the sock or coupled to the interior of the sock. In some embodiments, the heel padding 14*c* can be an integrated component of the sock, such as for example where the heel padding 14*c* is embedded in the sock.

Figure 3B:
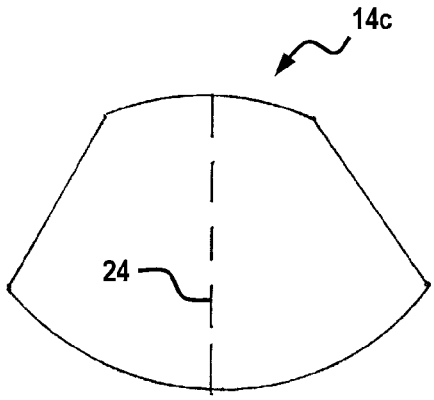
FIG. 3B is a plan view of a heel padding member according to an alternative embodiment of the present invention.

In some embodiments, the heel padding 14*c* can have a generally four-sided shape with two straight edges and two curved edges, as shown in FIG. 3B, with a line of symmetry 24 coincident to the sagittal plane of the foot when the sock is worn, as illustrated in FIG. 3A. This shape allows the final manufactured product the flexibility to be worn on either foot, similar to a conventional sock. The length along this line of symmetry 24 can be at least approximately 2 inches and/or less than or equal to approximately 4 inches in length. In other embodiments, the length of the line of symmetry 24 can be any other dimension. The curved margin along the superior edge when worn can be at least approximately 2 inches and/or less than or equal to approximately 4 inches in length, while the curved margin along the inferior edge when worn can be at least approximately 3 inches and/or less than or equal to approximately 5 inches in length. In other embodiments, the length of the margins along the superior and inferior edges can be any other dimension. Alternative shapes of the heel padding 14*c* are also contemplated and the shapes need not possess an axis or axes of symmetry. The overall dimensions of the heel padding 14*c* can vary taking into account the size of the final manufactured product (e.g., a smaller padding member reserved for socks worn by children and a larger padding member reserved for socks worn by adults). The thickness of the heel padding 14*c* can be at least approximately 0.125 inch (⅛ inch) and/or less than or equal to approximately 0.375 inch (⅜ inch), although other dimensions are also contemplated.

In some embodiments, the material of the heel padding 14*c* can be made of a flexible and durable material such as polyurethane foam. In other embodiments, the material can include other materials such as cotton, cotton-polyester blends, nylon, vinyl, rubber, leather, satin, suede, gel, silicone, fluid-filled material, Lycra, Spandex, or any other natural or synthetic textile material.

The sock illustrated in FIG. 3A is an athletic-type sock but the heel padding 14*c* can be incorporated into any sock type (e.g., no-show, ankle, quarter, crew, over-the-calf, athletic, casual, dress, men's, women's, etc) or any sock size (e.g., infant, child, adolescent, adult, etc).

Figure 4A:
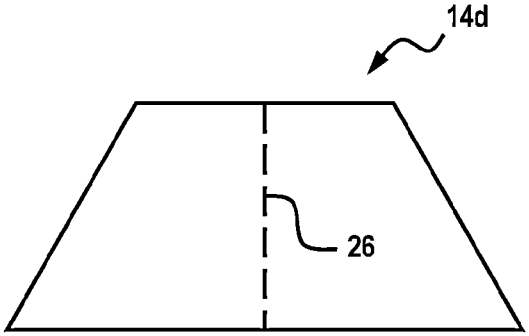
FIGS. 4A-4D are plan views of a heel padding member according to alternative embodiments of the present invention.
Figure 4B:
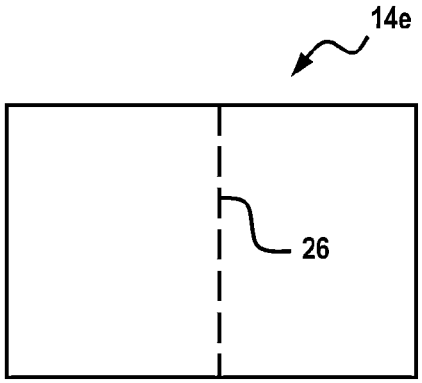
Figure 4C:
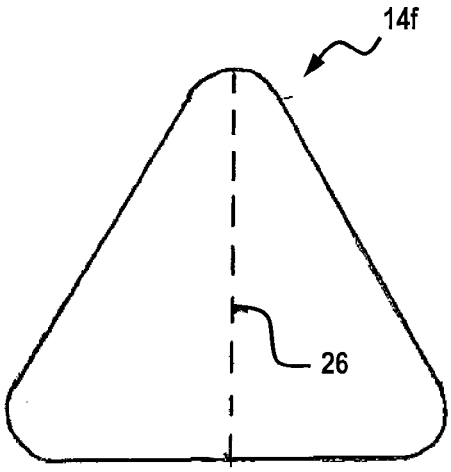
Figure 4D:
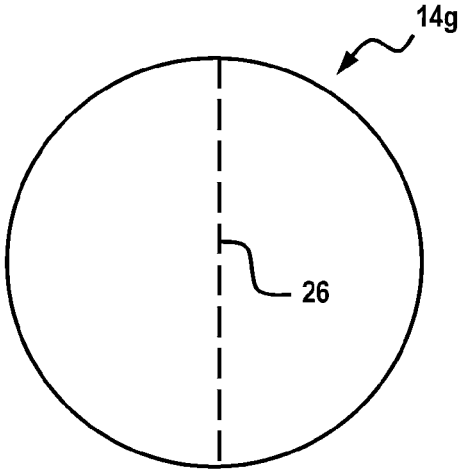

FIGS. 4A-4D illustrate alternative embodiments of the heel padding. For example, as illustrated in FIG. 4A, the heel padding 14*d* can have a generally trapezoidal shape. In another example, the heel padding 14*e* can have a generally rectangular shape, as illustrated in FIG. 4B. In some embodiments, the heel padding 14*f* can have a generally triangular shape, as illustrated in FIG. 4C. In still other embodiments, the heel padding 14*g* can have a generally circular shape, as illustrated in FIG. 4D. A line of symmetry 26, as shown in FIGS. 4A-4D, can be aligned coincident to the sagittal plane of the foot when the sock assembly is worn. Similar to the above described embodiments, the symmetrical feature of the heel paddings 14*d*, 14*e*, 14*f*, 14*g* can advantageously allow the final manufactured product to be worn on either foot, similar to a conventional sock.

In some embodiments, the length of the line of symmetry 26 can be at least approximately 1 inch and/or less than or equal to approximately 3 inches in length. In other embodiments, the length of the line of symmetry 26 can be any other dimension. Alternative shapes are also contemplated and need not possess an axis or axes of symmetry. The overall dimensions of the heel paddings can vary taking into account the size of the final manufactured product (e.g., a smaller padding member reserved for socks worn by children and a larger padding member reserved for socks worn by adults). The thickness of the heel paddings can be at least approximately 0.125 inch (⅛ inch) and/or less than or equal to approximately 0.375 inch (⅜ inch), although other dimensions are also contemplated. Similar to above embodiments, the material of the heel paddings can be made of a flexible and durable material such as polyurethane foam. In other embodiments, the material can include other materials such as cotton, cotton-polyester blends, nylon, vinyl, rubber, leather, satin, suede, gel, silicone, fluid-filled material, Lycra, Spandex, or any other natural or synthetic textile material.

Although certain embodiments, features, and examples have been described herein, it will be understood by those skilled in the art that many aspects of the methods and devices illustrated and described in the present disclosure may be differently combined and/or modified to form still further embodiments. For example, any one component of the sock assembly illustrated and described above can be used alone or with other components without departing from the spirit of the present invention. Additionally, it will be recognized that the methods described herein may be practiced in different sequences, and/or with additional devices as desired. Such alternative embodiments and/or uses of the methods and devices described above and obvious modifications and equivalents thereof are intended to be included within the scope of the present invention. Thus, it is intended that the scope of the present invention should not be limited by the particular embodiments described above, but should be determined only by a fair reading of the claims that follow.

What is claimed is:

1. A method of using heel padding to create comfort and fit for a person's foot in an oversized shoe, comprising:

choosing a sock that fits the person's foot, wherein the sock has a cuff portion on a proximal end of the sock with an opening for receiving the person's foot, a toe portion on a distal end of the sock for receiving toes of the person's foot, and a heel portion between the toe portion and the cuff portion for receiving a heel of the person's foot;

selecting at least one material to serve as heel padding for the sock;

attaching the at least one material to the heel portion of the sock;

inserting the person's foot through the cuff portion of the sock;

fitting the person's foot with the sock by pulling the sock onto the person's foot to minimize bunching of the sock on the person's foot;

inserting the person's foot fitted with the sock through a topline of the oversized shoe;

adjusting the person's foot fitted with the sock within the oversized shoe to a resting position with the heel padding located below the topline of the oversized shoe and between the heel of the person's foot and a counter area of the oversized shoe; and adjusting the heel padding on the sock to position the heel padding below the person's Achilles tendon and to cover portions of the medial and lateral aspects of the person's heel.

2. The method of claim 1, wherein selecting the at least one material to serve as heel padding for the sock comprises choosing the at least one material from a package containing a plurality of cushioning materials, each cushioning material having a thickness between 0.125 inches and 0.375 inches.

3. The method of claim 1, further comprising determining a target orientation for the heel padding solely within the heel portion of the sock after fitting the person's foot with the sock and when the person's heel is in the heel portion of the sock.

4. The method of claim 1, wherein the heel padding has at least one surface having a short-axis and a long-axis, wherein the short-axis intersects the long-axis at a geometric center of the surface, and the short-axis has a length approximately 1-inch and the long-axis has a length between 2-inches and 5-inches.

5. The method of claim 4, wherein the short-axis is perpendicular to the long-axis.

6. The method of claim 1, wherein the heel padding has at least one surface with four sides, wherein two sides of the four-sided surface are straight and the other two sides of the four-sided surface are curved, the two straight sides and the two curved sides forming perimeter margins of the four-sided surface.

7. The method of claim 6, wherein one of the two curved sides is a superior margin and the other one of the two curved sides is an inferior margin, wherein the superior margin has a length that is shorter than a length of the inferior margin, and the superior margin and the inferior margin are on opposite sides of the four-sided surface.

8. A method to improve comfort and fit of a person's foot in an oversized shoe, comprising:

selecting a sock that fits the person's foot, wherein the sock has a toe portion on a distal end of the sock for receiving toes of the person's foot, a cuff portion on a proximal end of the sock with an opening for receiving the person's foot, and a heel portion between the toe portion and the cuff portion for receiving a heel of the person's foot;

selecting a padding member to insert into a pouch located within the heel portion of the sock;

inserting the padding member into the pouch of the sock;

inserting the person's foot through the cuff portion of the sock;

fitting the person's foot with the sock by pulling the sock onto the person's foot to minimize bunching of the sock on the person's foot, so that the toes of the person's foot rest in the toe portion of the sock, and so that the heel of the person's foot rests in the heel portion of the sock;

inserting the person's foot fitted with the sock through a topline of the oversized shoe; and adjusting the padding member so that the padding member is positioned below the topline of the oversized shoe and between the heel of the person's foot and a counter area of the oversized shoe, and so that the padding member cradles a curvature provided by an interior surface of the counter area of the oversized shoe.

9. The method of claim 8, further comprising adjusting the padding member in the pouch to position the padding member below the person's Achilles tendon and to cover portions of the medial and lateral aspects of the person's heel.

10. The method of claim 9, further comprising determining a target orientation for the padding member within the heel portion of the sock after fitting the person's foot with the sock and when the person's heel is in the heel portion of the sock, and attaching the pouch to the heel portion of the sock to cover the target orientation.

11. The method of claim 8, wherein the padding member comprises at least one cushioning material, each of the at least one cushioning material having a thickness between 0.125 inches and 0.375 inches.

12. A method to improve comfort and fit of a person's foot in an oversized shoe, comprising selecting a hosiery that fits the person's foot and that is configured to cover at least a heel of the person's foot;

fitting the hosiery on the person's foot so that it covers the heel of the person's foot;

positioning a padding member to that portion of the hosiery covering the person's heel so that the padding member covers portions of the posterior, medial and lateral aspects of the person's heel;

inserting the person's foot fitted with the hosiery into the oversized shoe; and adjusting the hosiery on the person's foot so that the padding member is positioned between the person's heel and a counter area of the oversized shoe, and so that the padding member cradles a curvature provided by an interior surface of the counter area of the oversized shoe.

13. The method of claim 12, further comprising adjusting the padding member on the hosiery so that the padding member is positioned below the person's Achilles tendon.

14. The method of claim 12, wherein the hosiery is a sock that has a toe portion on a distal end of the sock for receiving toes of the person's foot, a cuff portion on a proximal end of the sock with an opening for receiving the person's foot, and a heel portion between the toe portion and the cuff portion for receiving the person's heel, and wherein the padding member is selected from at least one material that has a thickness between 0.125 inches and 0.375 inches.

15. The method of claim 14, further comprising determining a target orientation for the padding member within the heel portion of the sock after fitting the person's foot with the sock and when the person's heel is in the heel portion of the sock, and attaching the padding member to the heel portion of the sock to cover the target orientation so that the padding member is only covering a portion of the person's heel above the plantar surface of the person's foot.

16. The method of claim 12, further comprising selecting at least one material with a four-sided surface to serve as the padding member, wherein the four-sided surface of the material has a trapezoidal shape with two parallel sides and two nonparallel sides, each of the two parallel sides having a midpoint between endpoints of the parallel side, wherein the two parallel sides of the four-sided surface are separated by the two nonparallel sides, and the four-sided surface has a line of symmetry between the midpoints of the two parallel sides.

17. The method of claim 16, wherein the person's heel has a sagittal plane, wherein positioning the padding member to that portion of the hosiery covering the person's heel further comprises aligning the line of symmetry of the four-sided surface coincident to the sagittal plane of the person's heel, and wherein the distance between the midpoints of the two parallel sides is approximately 1-inch along the line of symmetry of the four-sided surface.

18. The method of claim 12, further comprising selecting at least one material having two straight sides and two curved sides forming a four-sided surface, each of the two curved sides having a midpoint between endpoints of the curved side, wherein the two curved sides of the four-sided surface are separated by the two straight sides, and the four-sided surface has a line of symmetry between the midpoints of the two curved sides.

19. The method of claim 18, wherein the person's heel has a sagittal plane, wherein positioning the padding member to that portion of the hosiery covering the person's heel further comprises aligning the line of symmetry of the four-sided surface coincident to the sagittal plane of the person's heel, and wherein one of the two curved sides has a length of approximately 2-inches.

* * * * *